US008315855B2

(12) United States Patent
Yoshioka

(10) Patent No.: US 8,315,855 B2
(45) Date of Patent: Nov. 20, 2012

(54) VOICE PROCESSING APPARATUS AND METHOD

(75) Inventor: Yasuo Yoshioka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 577 days.

(21) Appl. No.: 12/460,650

(22) Filed: Jul. 22, 2009

(65) Prior Publication Data

US 2010/0023321 A1 Jan. 28, 2010

(30) Foreign Application Priority Data

Jul. 25, 2008 (JP) ..... 2008-191973

(51) Int. Cl.
*G10L 11/04* (2006.01)

(52) U.S. Cl. ..... 704/207; 704/206; 704/209

(58) Field of Classification Search ..... 704/258, 704/260, 244, 268, 207, 266, 200, 205, 206, 704/209, 220

See application file for complete search history.

(56) References Cited

U.S. PATENT DOCUMENTS

| | | | | |
|---|---|---|---|---|
| 7,315,813 | B2 * | 1/2008 | Kuo et al. | 704/207 |
| 2004/0024600 | A1 * | 2/2004 | Hamza et al. | 704/268 |
| 2008/0235025 | A1 * | 9/2008 | Murase et al. | 704/260 |
| 2010/0004931 | A1 * | 1/2010 | Ma et al. | 704/244 |

FOREIGN PATENT DOCUMENTS

| | | | |
|---|---|---|---|
| JP | 10-011083 | A | 1/1998 |
| JP | 2003-066982 | A | 3/2003 |
| JP | 2004 252085 | | 9/2004 |
| JP | 2008-191973 | | 7/2008 |
| WO | WO 97/43756 | | 11/1997 |

OTHER PUBLICATIONS

Extended European Search Report for Application No. 09165378.2-2225, dated Nov. 11, 2009 (7 pgs).

Yuji Sato: Voice Quality Conversion Using Interactive Evolution of Prosodic Control, (Accepted Date: Jun. 21, 2004; 6 pgs.).

Japanese Patent Office, "Notice of Grounds for Rejection" Patent Application No. P2008-191973 of Yamaha Corporation; Issue Date: Jun. 19, 2012; 2 pages.

* cited by examiner

*Primary Examiner* — Huyen X. Vo

(74) *Attorney, Agent, or Firm* — Pillsbury Winthrop Shaw Pittman LLP

(57) ABSTRACT

Character extraction section extracts character amounts, pertaining to a prosody of voice, from a voice signal sequentially in a time-serial manner. Difference value calculation calculates a difference value between each of the extracted character amounts and a reference value. Processing values, corresponding to the individual character amounts, are generated in accordance with the respective difference values, and a voice processing section controls the individual character amounts of the voice signal in accordance with the processing values corresponding to the character amounts and thereby generates an output signal having a prosody changed from the prosody of the voice signal.

18 Claims, 3 Drawing Sheets

VOICE PROCESSING APPARATUS AND METHOD

BACKGROUND

The present invention relates to a technique for emphasizing or depressing a prosody (e.g., modulation of a volume, pitch, etc.) of voice.

Heretofore, there have been proposed techniques for varying a prosody of voice. Japanese Patent Application Laid-open Publication No. 2004-252085, for example, discloses a technique for depressing a prosody by decreasing variation widths of a volume and pitch of a voice signal to predetermined ranges (hereinafter referred to as "reference ranges"). The reference ranges are fixedly set in accordance with standard variation widths of volumes and pitches of voice uttered or generated in a calm state.

However, with the technique disclosed in the No. 2004-252085 publication, where the fixedly-set reference ranges are used to depress a volume and pitch irrespective of characters of a voice signal to be actually processed, it is difficult to perform appropriate voice prosody control corresponding to the characters of the voice signal. For example, if the volume and pitch of a voice signal to be processed fall within the reference ranges, there would occur no change in prosody between before and after the processing.

SUMMARY OF THE INVENTION

In view of the foregoing, it is an object of the present invention to provide an improved voice processing apparatus and method which can appropriately control a prosody of voice in accordance with a character of a voice signal.

In order to accomplish the above-mentioned object, the present invention provides an improved voice processing apparatus, which comprises: a character extraction section that extracts character amounts, pertaining to a prosody of voice, from a voice signal sequentially in a time-serial manner; a difference calculation section that calculates a difference value between each of the character amounts extracted by the character extraction section sequentially in a time-serial manner and a reference value; a processing value generation section that generates processing values, corresponding to individual ones of the character amounts, in accordance with respective ones of the difference values; and a voice processing section that controls the individual character amounts of the voice signal in accordance with the processing values corresponding to the character amounts and thereby generates an output signal having a prosody changed from the prosody of the voice signal.

According to the voice processing apparatus of the present invention constructed in the aforementioned manner, an output signal having a prosody changed from the prosody of the voice signal is generated by use of the processing values corresponding to the difference values between the individual character amounts of the voice signal and the reference value. Thus, the voice processing apparatus of the present invention can appropriately control the prosody in accordance with the individual character amounts of the voice signal, as compared to the prior art technique disclosed in the No. 2004-252085 publication where the volume and pitch of a voice signal are restricted to within the respective fixed reference ranges.

In a preferred implementation, the processing value generation section calculates, as the processing value, a numerical value obtained by subtracting the difference value from a predetermined function value calculated using the difference value as an independent variable, and the voice processing section generates the output signal by changing the individual character amounts of the voice signal by the corresponding processing values. Such an arrangement can advantageously control increase/decrease of character amounts of the output signal on the basis of the reference value while accurately reflecting the character amounts of the voice signal in the output signal.

Preferably; when the prosody is to be emphasized, the processing value generation section calculates the processing value on the basis of the function value set such that the absolute value of the function value exceeds the absolute value of the difference value, but, when the prosody is to be emphasized, the processing value generation section calculates the processing value on the basis of the function value set such that the absolute value of the function value falls below the absolute value of the difference value. Such an arrangement can achieve both emphasis and depression of the prosody.

In a preferred implementation, the processing value generation section calculates the processing value such that a rate of change, relative to the difference value, of the processing value increases as the absolute value of the difference value increases (see, for example, functions F2A and F2B in FIG. 6). Because the rate of change of the processing value increases as the absolute value of the difference value increases, such an arrangement can sufficiently change (emphasize or depress) the prosody, as compared to a case where the processing value changes relative to the difference value at a fixed rate of change (i.e., in a linear manner).

In a preferred implementation, the processing value generation section calculates the processing value such that the rate of change, relative to the difference value, of the processing value decreases as the absolute value of the difference value increases (see, for example, functions F3A and F3B in FIG. 7). Because the rate of change of the processing value decreases as the absolute value of the difference value increases, such an arrangement can reduce a degree of change (emphasis or depression) of the prosody, as compared to the case where the processing value changes relative to the difference value at a fixed rate of change (i.e., in a linear manner).

In a preferred implementation, the processing value generation section variably controls relationship between the difference values and the processing values. Such an arrangement can advantageously generate an output signal having a diversely changed prosody, as compared to a case where relationship between the difference values and the processing values is fixed. In this case, the processing value generation section may variably control the relationship between the difference values and the processing values in any desired manner. For example, there may be employed a scheme in which any one of different kinds of functions (e.g., functions F1A-F3A, F1B-F3B) defining relationship between the difference values and the processing values is selectively used, or where a coefficient of one kind of function defining relationship between the difference values and the processing values (e.g., slope of a function F1A or F1B in FIG. 3) is varied.

Note that the reference value to be used by the difference calculation section may be set in any desired manner. For example, the reference value may be set at a predetermined value irrespective of the voice signal. However, with a viewpoint to restricting a discrepancy in characteristic between the output signal and the voice signal, it is preferable to set the reference value in accordance with a plurality of character amounts extracted by the character extraction section. For example, the maximum or minimum value of the plurality of character amounts may be set as the reference value, or an average value of the plurality of character amounts may be set as the reference value. With a viewpoint to effectively restricting a discrepancy in characteristic (e.g., volume feeling or pitch feeling) between the output signal and the voice signal, it is particularly advantageous to set an average value of the plurality of character amounts as the reference value.

The voice processing apparatus according to the aforementioned preferred implementations of the present invention may be implemented by hardware (electronic circuitry), such as a DSP (Digital Signal processor) dedicated to the inventive voice processing, as well as by cooperation between a general-purpose arithmetic operation processing device, such as a CPU (Central processing Unit), and a software program.

Further, the present invention may also be practiced as a method implemented by a computer for processing voice, or as a computer readable storage medium containing a group of instructions for causing a computer to perform a voice processing procedure. The method, storage medium or program can accomplish generally the same behavior and advantageous benefits as the aforementioned preferred implementations of the voice processing apparatus. The program of the present invention may not only be supplied to a user stored in a computer-readable storage medium and then installed in a computer of the user, but also be delivered from a server apparatus via a communication network and then installed in a computer of a user.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

First Embodiment

Figure 1:
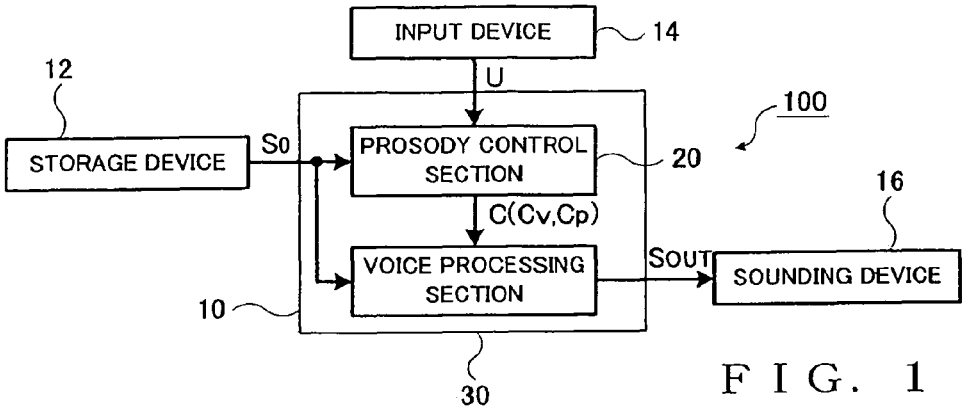
FIG. 1 is a block diagram of a voice processing apparatus according to a first embodiment of the present invention.

FIG. 1 is a block diagram of a voice processing apparatus 100 according to a first embodiment of the present invention. As shown in the figure, the voice processing apparatus 100 comprises a computer system including an arithmetic operation processing device 10 and a storage device 12. The storage device 12 stores therein programs for execution by the arithmetic operation processing device 10, and data for use by the arithmetic operation processing device 10. For example, a voice signal SO is stored in the storage device 12, which is a train of samples indicative of a time axial waveform of voice. The storage device 12 may comprise any desired storage medium, such as a semiconductor storage medium or a magnetic storage medium.

The arithmetic operation processing device 10 functions as a prosody control section 20 and a voice processing section 30 by executing programs stored in the storage device 12. The voice processing section 30 changes (emphasizes or depresses) the prosody of the voice signal SO to thereby generate an output signal SOUT. The term "prosody" is used herein to mean modulation (intonation) or tone of voice (utterer's feeling) perceived by a listener by virtue of acoustic characters (typically, volume and pitch) of the voice. Voice with an emphasized prosody gives the listener an emotional or sentimental impression, while voice with a depressed prosody gives the listener with an inorganic or intellectual impression. The voice processing section 30 in the instant embodiment generates an output signal SOUT by changing the volume and pitch of the voice signal SO. Thus, the instant embodiment can advantageously generate an output signal SOUT of a desired prosody even where a plurality of voice signals SO of different prosodies are not prepared in advance; accordingly, the instant embodiment can reduce the necessary capacity of the storage device 12 for storing such voice signals SO.

The prosody control section 20 of FIG. 1 generates processing values C (CV, CP) each for controlling the change, by the voice processing section 30, of the prosody. The processing values C are variables designating forms of a prosody change, such as a direction of the prosody change (i.e., emphasis or depression of the prosody) and a degree of the prosody change. The processing value CV designates a change of the volume, and the processing value CP designates a change of the pitch. In the following description, a suffix "V" is added to each element pertaining to the volume, while a suffix "P" is added to each element pertaining to the pitch; however, the addition of such suffixes is omitted where there is no need to distinguish between the volume and the pitch (i.e., where elements common to the volume and pitch are described).

Input device 14 and sounding device 16 are connected to the arithmetic operation processing device 10. The input device 14 includes operating members (operators) operable by a human operator or user to give various instructions to the voice processing apparatus 100. By appropriately operating the input device 14, the user can give control parameter values (hereinafter sometimes referred to as "control values") U, indicative for example of a direction of a prosody change (i.e., whether the prosody is to be emphasized or depressed) and a degree of the prosody change. The sounding device 16, comprising for example a speaker or headphone, radiates voice corresponding to an output signal SOUT generated by the arithmetic operation processing device 10.

Figure 2:
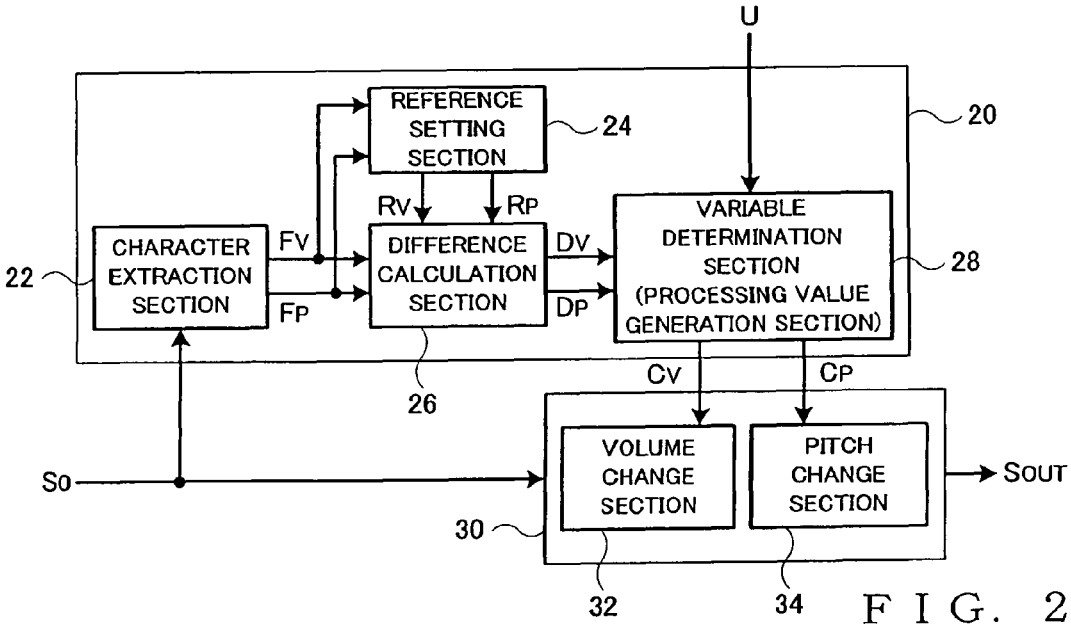
FIG. 2 is a block diagram showing specific constructions of a prosody control section and voice processing section.

FIG. 2 is a block diagram of the prosody control section 20 and voice processing section 30. As shown in the figure, the prosody control section 20 includes a character extraction section 22, a reference setting section 24, a difference calculation section 26, and a variable determination section (processing value generation section) 28. The character extraction section 22 sequentially extracts character amounts F (FV, FP) for individual ones of a plurality of unit segments (each having a 10 msec time length) obtained by dividing the entire length of the voice signal SO along the time axis. More specifically, the character extraction section 22 extracts a volume FV and pitch FP of the voice signal SO for each of the unit segments; such character extraction may be performed using any desired known technique. If no pitch FP could be detected (for example, because the volume of the voice signal SO is zero or the voice signal SO has no harmonic structure), the pitch FP is set at zero.

The reference setting section 24 variably sets reference values R (RV, RP) in accordance with the character amounts F (FV, FP) extracted by the character extraction section 22. For example, for each of the character types, i.e. volume and pitch in this case, an average of a plurality of the character amounts F is set as the reference value R. Namely, the reference setting section 24 calculates an average value of volumes FV, extracted for all of the segments of the voice signal SO, as the reference value RV, and calculates an average value of pitches FP, extracted for all of the segments of the voice signal SO, as the reference value RP.

The difference calculation section 26 calculates a difference value D (DV, DP) between each of the character amounts F identified by the character extraction section 22 for each of the unit segments and the reference value R set by the reference setting section 24 on the basis of the character amount F. More specifically, the difference calculation section 26 calculates a difference value DV by subtracting the extracted reference value RV from the volume FV for each of the unit segments (DV=FV−RV) and calculates a difference value DP by subtracting the reference value RP from the extracted pitch FP for each of the unit segments (DP=FP−RP). Namely, such difference values D (DV, DP) are calculated for each of the unit segments.

The variable determination section (processing value generation section) 28 generates, for each of the unit segments, processing values C (CV, CP), corresponding to the character amounts F, in accordance with the difference values D (DV, DP) calculated by the difference calculation section 26. More specifically, for each of the unit segments, the variable determination section 28 calculates a processing value CV corresponding to the difference value DV and a processing value CP corresponding to the difference value DP.

Figure 3:
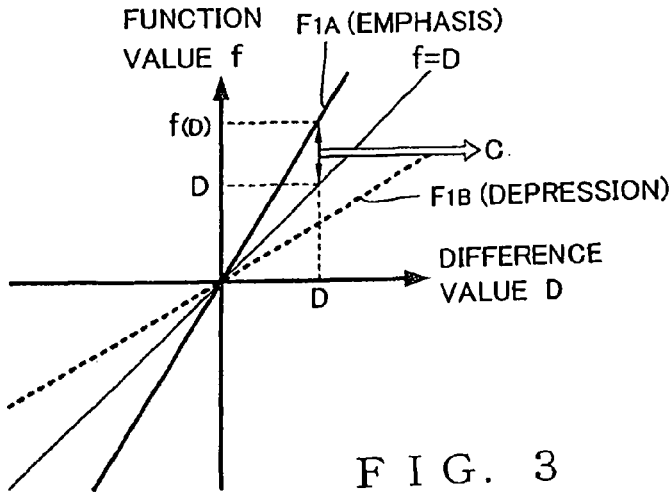
FIG. 3 is a conceptual diagram showing relationship between difference values and processing values.

FIG. 3 is a conceptual diagram explanatory of relationship between the difference values D and the processing values C. The variable determination section 28 calculates such a processing value C using a function F1 (F1A, F1B) whose function value f is set to linear vary (or monotonously increase) relative to the difference value D. As shown in the figure, if the control parameter value (control value) U indicates emphasis of a prosody, the function F1A is used, while, if the control parameter value U indicates depression of a prosody, the function F1B is used. Further, if the control parameter value U is a neutral value indicating neither emphasis nor depression of a prosody, a linear function of a slope "1" is used.

The slope of the function F1A (i.e., change rate of the function value f relative to the difference value D) is variably set, in accordance with the control parameter value U, within a range greater than "1". Therefore, the absolute value of the function value f(D) of the function F1A exceeds the absolute value of the difference value D. The slope of the function F1B, on the other hand, is variably set, in accordance with the control parameter value U, within a positive value range smaller than "1". Therefore, the absolute value of the function value f(D) of the function F1B falls below the absolute value of the difference value D. The control parameter value U may be variably generated in response to operation of a human operator, or variably automatically generated in accordance with some factor, such as an ambient environment.

The variable determination section 28 subtracts the difference value D from the function value f(D), corresponding to the difference value D, of the function F1 (F1A or F1B) and sets a value obtained by the subtraction as a processing value C(C=f(D)−D). Thus, the processing value C varies in accordance with (i.e., in proportion to) the difference value D; that is, as the absolute value of the difference value D increases, the absolute value of the processing value C increases. Further, in a case where the difference value D is a positive value, the processing value C when the prosody is to be emphasized (i.e., when the function F1A is to be used) is set at a positive value, while the processing value C when the prosody is to be depressed (i.e., when the function F1B is to be used) is set at a negative value. Furthermore, in a case where the difference value D is a negative value, the processing value C when the prosody is to be emphasized (i.e., when the function F1A is to be used) is set at a negative value, while the processing value C when the prosody is to be depressed (i.e., when the function F1B is to be used) is set at a positive value. Note that, where the control parameter value U is a neutral value, the processing value C is "0" irrespective of the difference value D.

In accordance with the processing value C determined by the variable determination section 28 for each of the unit segments of the voice signal SO, the voice processing section 30 of FIG. 2 increases or decreases the character amount F of the unit segment of the voice signal SO, to thereby generate an output signal SOUT. As shown in the figure, the voice processing section 30 includes a volume change section 32 and a pitch change section 34.

The volume change section 32 changes the volume amount FV of each of the unit segments of the voice signal SO in accordance with the processing value CV of the unit segment. Namely, the volume change section 32 changes the volume FV of each of the unit segments of the voice signal So to a sum between the volume amount FV and the processing value CV. Similarly, the pitch change section 34 changes the pitch FVP of each of the unit segments of the voice signal SO in accordance with the processing value CV of the unit segment. Namely, the pitch change section 34 changes the pitch FP of each of the unit segments of the voice signal SO to a sum between the pitch FP and the processing value CP. Through the conversion of the volume FV by the volume change section 32 and the conversion of the pitch FP by the pitch change section 34, an output signal SOUT is generated from the voice signal SO.

Because the character amount F of each of the unit segments of the voice signal SO corresponds to a sum between the reference value R and the difference value D(F=R+D), the sum between the volume amount FV of the voice signal SO and the processing value CV (i.e., character amount of the output signal SOUT) equals a sum between the reference value R and the function value f(D) as follows:

$$F + C = (R + D) + (f(D) - D) \quad (1)$$
$$= R + f(D)$$

Figure 4:
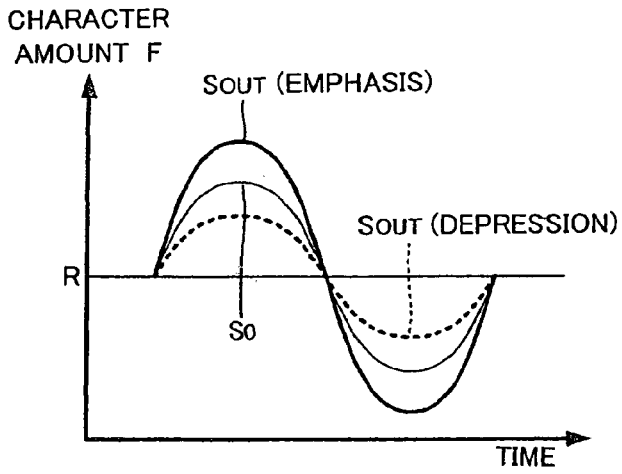
FIG. 4 is a conceptual diagram schematically showing how a prosody of a voice signal varies.
Figure 5:
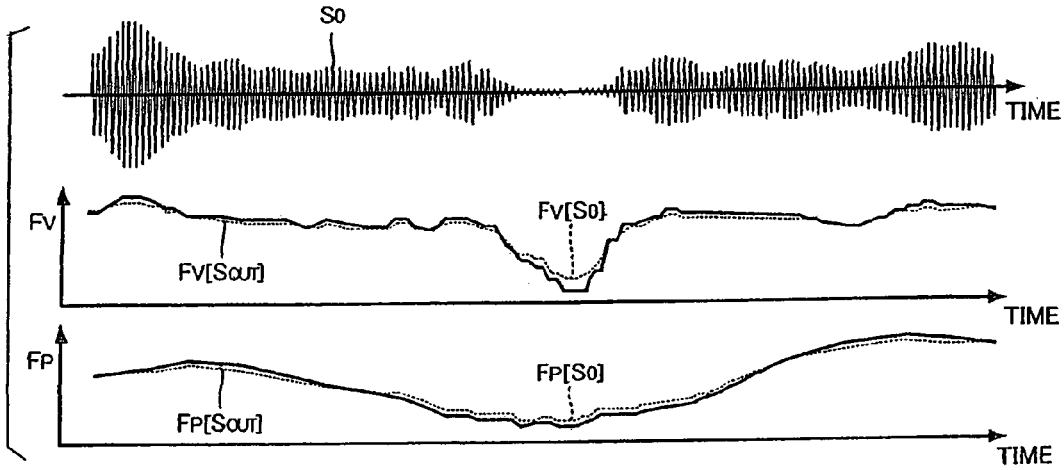
FIG. 5 is a conceptual diagram schematically showing how a volume and pitch of a voice signal vary.

FIG. 4 is a conceptual diagram schematically showing variation over time of the character amounts F (volume FV and pitch FP) of the voice signal SO and output signal SOUT. FIG. 5 is a conceptual diagram schematically showing variation over time of the volume FV and pitch FP of the output signal SOUT having an emphasized prosody, together with a waveform of the voice signal SO (shown at the uppermost section of the figure). In FIG. 5, the volume FV and pitch FP of the voice signal SO are indicated by broken line together with the volume FV and pitch FP of the output signal SOUT.

As described above with reference to FIG. 3, in a case where emphasis of the prosody has been instructed, the processing value C is set at a positive value when the corresponding difference value D is a positive value (i.e., when the character amount F of the voice signal SO is greater than the reference value R), but set at a negative value when the difference value D is a negative value. Thus, as shown in FIGS. 4 and 5, the character amount F of the output signal SOUT will have an increased variation width as compared to the character amount F of the voice signal SO (namely, the absolute value of the character amount F of the output signal SOUT exceeds the absolute value of the character amount F of the voice signal SO). Namely, reproduced voice of the output signal SOUT represents a result of the voice signal SO having been emphasized in prosody (volume and pitch variation). Also, because the absolute value of the processing value C increases as the absolute value of the difference value D increases as shown in FIG. 3, a difference in character amount F between the voice signal SO and the output signal SOUT increases as the character amount F of the voice signal SO deviates from the reference value R.

In a case where depression of the prosody has been instructed, on the other hand, the processing value C is set at a negative value when the corresponding difference value D is a positive value, but set at a positive value when the corresponding difference value D is a negative value. Thus, as shown in FIG. 4, the character amount F of the output signal SOUT will have a decreased increased variation width as compared to the character amount F of the voice signal SO. Namely, reproduced voice of the output signal SOUT represents a result of the voice signal SO having been depressed in prosody (volume and pitch variation). Also, a difference in character amount F between the voice signal SO and the output signal SOUT increases as the character amount F of the voice signal SO deviates from the reference value R, as in the case where emphasis of the prosody has been instructed.

With the instant embodiment, as set forth above, the degree of depression of the prosody is variably controlled in accordance with the character amounts F of the voice signal SO, it is possible to appropriately control the prosody in accordance with the character amounts F of the voice signal SO as compared to the prior art technique disclosed in patent literature 1 above where the volume and pitch of the voice signal SO are merely depressed to within the reference ranges. For example, even when the voice signal SO has a small volume, the instant embodiment can control the prosody reliably and finely. Further, because the rate of change (or slope) of the function F1 (F1A, F1B), which is to be used for calculating a processing value C from the difference value D, is variably controlled, the instant embodiment can also appropriately adjust the rate of change of the prosody in the output signal SOUT.

Further, with the prior art technique disclosed in patent literature 1, where the reference ranges are set independently of the voice signal, there would arise the problem that, where, for example, the volume and pitch of the voice signal substantially deviate from middle values of their respective reference ranges, the voice characters would undesirably vary prominently between before and after depression of the prosody. By contrast, the instant embodiment of the invention is arranged to generate an output signal SOUT by changing the character amounts F of the voice signal SO by amounts corresponding to the processing values C each calculated by subtracting the difference value D from the function value f(D) of the function F1. Thus, as seen from Mathematical Expression (1) above and FIG. 4, the instant embodiment can advantageously generate an output signal SOUT representing variation of the character amount F (i.e., prosody) of the voice signal SO having been emphasized or depressed on the basis of the reference value R. Further, because an average of a plurality of character amounts F is set as the reference value R, the average value of the character amounts F can be substantially the same between the voice signal SO and the output signal SOUT. As a result, the instant embodiment can achieve the particular advantageous benefit of prominently reducing a discrepancy in character between the voice signal SO and the output signal SOUT.

Second Embodiment

The following describe a second embodiment of the present invention. Similar elements to those in the first embodiment are indicated by the same reference numerals and characters as used for the first embodiment and will not be described in detail here to avoid unnecessary duplication.

In the second embodiment, the variable determination section 28 retains three different kinds of functions F (F1-F3). The variable determination section (processing value generation section) 28 selectively uses any one of the three different kinds of functions F (F1-F3) to calculate a processing value C. Any one of the three different kinds of functions F (F1-F3) which is to be selected by the variable determination section 28 is designated by the user via the input device 14. Manner in which the variable determination section 28 calculate a processing value C from a difference value D using the function F2 or F3 is the same as in the aforementioned first embodiment in which a processing value C is calculated on the basis of the function F1.

Figure 6:
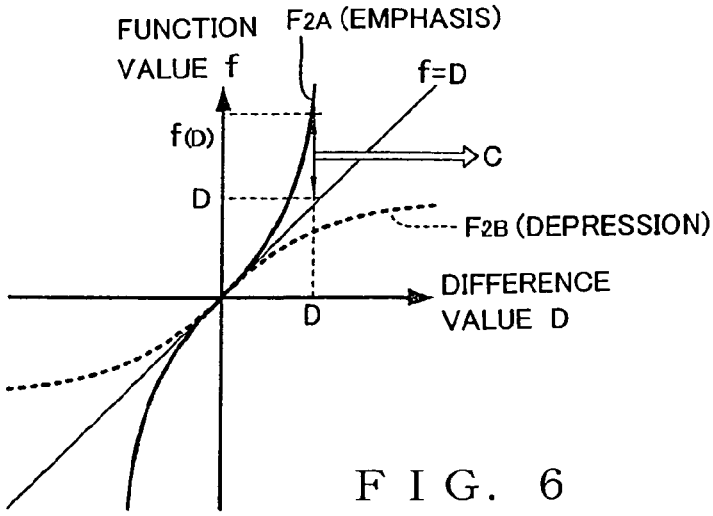
FIG. 6 is a conceptual diagram showing relationship between difference values and processing values in a second embodiment of the present invention.
Figure 7:
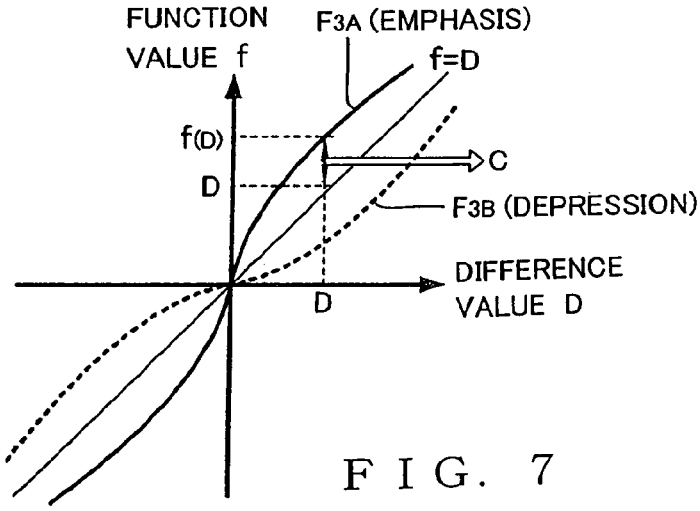
FIG. 7 is a conceptual diagram showing relationship between difference values and processing values in the second embodiment of the present invention.

FIG. 6 is a conceptual diagram showing the function F2 (F2A, F2B), and FIG. 7 is a conceptual diagram showing the function F3 (F3A, F3B). As with the function F1 in the first embodiment, any one of the functions (F1A, F2A, F3A) where the absolute value of the function value f(D) exceeds the absolute value of the difference value D is used to calculate the processing value C, in the case where the prosody is to be emphasized. Further, any one of the functions (F1B, F2B, F3B) where the absolute value of the function value f(D) falls below the absolute value of the difference value D is used to calculate the processing value C, in the case where the prosody is to be depressed.

For each of the functions F2A and F3B, as shown in FIGS. 6 and 7, relationship between the difference values D and the function values f(D) is defined such that, as the absolute value of the difference value D increases, the rate of change of the function value f(D) corresponding to the difference value D increases (and thus the function value f(D) varies curvilinearly relative to the difference value D). Further, for each of the functions F2B and F3A, relationship between the difference values D and the function values f(D) is defined such that, as the absolute value of the difference value D increases, the rate of change of the function value f(D) corresponding to the difference value D decreases.

As understood from the foregoing, when the function F2 (F2A, F2B) is selected, the rate of change of the processing value C relative to the difference value D increases as the absolute value of the difference value D increases; namely, the absolute value of the processing value C increases exponentially in response to variation of the absolute value of the difference value D. Thus, in this case, an amount of variation (variation width) of the character amount F of the output signal SOUT relative to the character amount of the voice signal SO increases as compared to that in the case where the function F1 is used. Namely, in this case, it is possible to increase the degree of variation (emphasis or depression) of the prosody as compared to the case where the function F1 is used.

When the function F3 (F3A, F3B) is selected, the rate of change of the processing value C relative to the difference value D decreases as the absolute value of the difference value D increases. Thus, for a unit segment where the difference value D is great, an amount of variation (variation width) in the character amount of the output signal SOUT relative to the voice signal SO decreases as compared to that in the case where the function F1 is used. Namely, in this case, it is possible to decrease the degree of variation (emphasis or depression) of the prosody as compared to the case where the function F1 is used.

In the above-described second embodiment, where any one of the plurality of kinds of functions F (F1-F3) is selectively used for calculation of the processing value C, it is possible to appropriately adjust a change of the prosody as necessary. Especially, the second embodiment, which allows the user to designate a desired function F to be used for calculation of the processing value C, can advantageously provide an output signal SOUT having a user-desired prosody.

Third Embodiment

Figure 8:
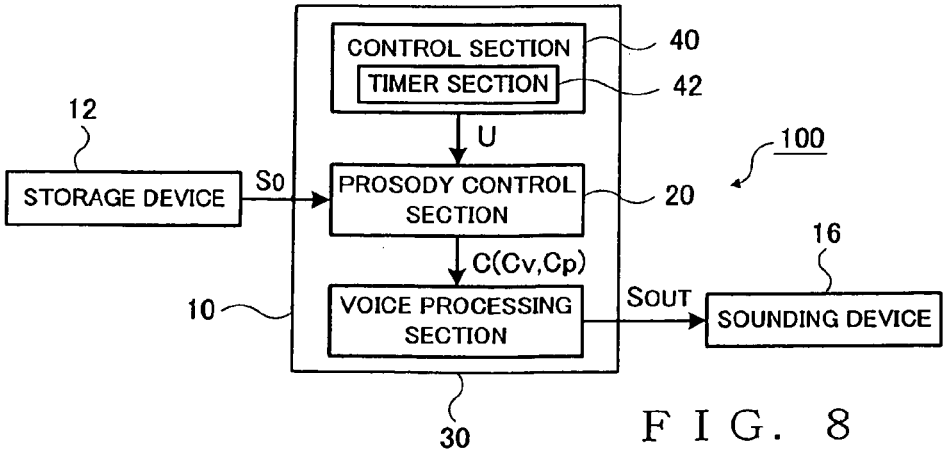
FIG. 8 is a block diagram of an electric apparatus according to a third embodiment of the present invention.

FIG. 8 is a block diagram of an electric apparatus, such as home electric equipment like a refrigerator or rice cooker, according to a third embodiment of the present invention. As shown in the figure, the electric apparatus includes a voice processing device 101. The voice processing device 101 is different from the voice processing device 100 of the first embodiment in that it includes a control section 40 for generating and outputting a control value U to the prosody control section 20. The control section 40 includes a timer section 42 for counting a current time t.

Voice signal SO of voice related to use of the electric apparatus (hereinafter referred to "guide voice") is stored in the storage device 12. The guide voice is, for example, voice presenting to the user how to use the electric apparatus and voice informing the user of an operating state of the electric apparatus and giving the user a warning. The prosody control section 20 and voice processing section 30 generates an output signals SOUT by changing the prosody of the voice signal SO in generally the same manner as in the first embodiment.

The control section 40 variably controls the control value U in accordance with the current time t counted by the timer section 42. For example, if the current time t is in the morning time zone, the control section generates and outputs, to the prosody control section 20, a control value U instructing emphasis of the prosody. If, on the other hand, the current time t is in the night time zone, the control section generates and outputs, to the prosody control section 20, a control value U instructing depression of the prosody. Thus, guide voice with an emphasized prosody is reproduced in the morning time zone, while guide voice with a depressed prosody is generated in the night time zone. In this way, the instant embodiment can generate guide voice with a prosody suitable for the time zone when the electric apparatus is used. Further, because there is no need to store in the storage device 12 voice signals SO of different prosodies, the instant embodiment can reduce the necessary capacity of the storage device 12.

<Modification>

The above-described embodiments may be modified variously, and the following are among specific examples of modifications. Note that two or more of the following modifications may be combined as desired.

(Modification 1)

Whereas the above-described embodiments have been constructed to calculate a processing value C (CV, CP) by the variable determination section 28 by performing arithmetic operations using the function F (F1-F3), there may be employed any other suitable way for determining a processing value C on the basis of the difference value D. For example, a data table having various difference values D and various processing values C stored in association with each other may be prepared in advance so that the variable determination section 28 can acquire, from the data table, a particular processing value C corresponding to the difference value D calculated by the difference calculation section 26 and thereby outputs the acquired processing value C to the voice processing section 30.

(Modification 2)

Whereas the above-described embodiments have been constructed to use an average of a plurality of character amounts F as the reference value R, there may be employed any other suitable way for calculating the reference value R. For example, the reference value R may be calculated on the basis of a plurality of character amounts F extracted by the character extraction section 22, or the maximum or minimum value of the plurality of character amounts F extracted by the character extraction section 22 may be used as the reference value R. Alternatively, the reference value R may be set irrespective of the voice signal SO.

Further, whereas the above-described embodiments have been constructed to use the same or common reference value R for calculation of a processing value C in every unit segment of the voice signal SO, the reference value R to be used for calculation of a processing value C may be made different for each of the unit segments of the voice signal SO. For example, the voice signal SO may be divided into some of a plurality of voice-present segments each containing voice and a plurality of voice-absent segments each containing no voice or containing only sound noise, in which case the reference setting section 24 calculates, individually for each of the voice-present segments, a reference value R corresponding to character amounts F of unit segments within the voice-present segment. Then, the difference calculation section 26 applies the reference value, calculated for each of the voice-present segments, to calculation of a difference value D for each of the unit segments within the voice-present segment. Such arrangements can appropriately control the prosody of the voice signal SO even when an acoustic character has changed in the middle of the voice signal SO.

(Modification 3)

Whereas the control section 40 in the third embodiment has been described as generating a control value U in accordance with the current time t, it may generate a control value U in accordance with any other suitable condition or factor than the current time t. For example, a separate control value U may be registered in advance individually for each of a plurality of potential users so that the control section 40 selects, from among the registered control values U, a particular control value U corresponding to an actual user and outputs (or designates) the selected control value U to the prosody control section 20. Further, an ambient environment condition, such as sound noise, may be detected so that a control value U suited for the detected ambient environment condition is automatically generated.

(Modification 4)

The character amounts F to be used for control of a prosody should not be understood as limited to those of volume FV and pitch FP. For example, the character extraction section 22 may extract, as the character amount F, a slope of a straight line approximating a region higher in frequency than a peak having the greatest intensity in a frequency spectrum (power spectrum) of a voice signal SO and then the voice processing section 30 changes the prosody on the basis of the slope; this arrangement too can generate an output signal SOUT presenting a prosody changed from that of the voice signal SO. Further, only one of the volume FV and pitch FP may be extracted as the character amount F. As understood from the foregoing, any numerical value pertaining to (i.e., characterizing) a prosody of voice is suitable as the character amount F.

(Modification 5)

Whereas the preferred embodiments have been described above as emphasizing or depressing a prosody of a voice signal SO, they may be suitably applied to a case where only one of emphasis or depression of a prosody is to be performed. For example, the voice processing apparatus 100 is dedicated only to emphasis of a prosody, the variable determination section 28 uses, for calculation of a processing value C, a function F (F1A, F2A, F3A) defining relationship such that the absolute value of the function value f exceeds the absolute value of the difference value D.

(Modification 6)

Supply source of a voice signal SO should not be understood as limited to the storage device 12. For example, the supply source may be a voice pickup device (microphone) that picks up ambient voice and generates a voice signal SO, or a reproduction device that reproduces a voice signal SO stored in a mobile or portable recording medium. Alternatively, there may be employed a construction where an output signal SOUT is generated from a voice signal SO synthesized through a conventionally-known voice synthesis technique.

(Modification 7)

Destination of an output signal SOUT generated by the voice processing section 30 should not be understood as limited to the sounding device 16. For example, there may be employed a construction where an output signal SOUT is retained in the storage device 12, or where an output signal SOUT is transmitted to another device via a communication network.

This application is based on, and claims priority to, JP PA 2008-191973 filed on 25 Jul. 2008. The disclosure of the priority application, in its entirety, including the drawings, claims, and the specification thereof, is incorporated herein by reference.

What is claimed is:

1. A non-transitory machine readable medium containing a program executable by a computer to perform a voice processing procedure, said voice processing procedure comprising:

a step of extracting character amounts, pertaining to a prosody of voice, from a voice signal sequentially in a time-serial manner;

a step of calculating a difference value between each of the character amounts extracted by said step of extracting sequentially in a time-serial manner and a reference value;

a step of generating processing values, corresponding to individual ones of the character amounts, in accordance with respective ones of the difference values, wherein said step of generating processing values calculates, as said processing value, a numerical value obtained by subtracting the difference value from a predetermined function value calculated using the difference value as an independent variable; and a step of controlling the individual character amounts of the voice signal in accordance with the processing values corresponding to the character amounts to generate an output signal having a prosody changed from the prosody of the voice signal, wherein said step of controlling the individual character amounts generates the output signal by changing the individual character amounts of the voice signal by the corresponding processing values.

2. A method for changing a prosody of a voice signal, the method comprising:

a step of extracting character amounts, pertaining to a prosody of voice, from a voice signal sequentially in a time-serial manner;

a step of calculating a difference value between each of the character amounts extracted by the step of extracting sequentially in a time-serial manner and a reference value;

a step of generating processing values, corresponding to individual ones of the character amounts, in accordance with respective ones of the difference values, wherein said step of generating processing values calculates, as said processing value, a numerical value obtained by subtracting the difference value from a predetermined function value calculated using the difference value as an independent variable; and a step of controlling the individual character amounts of the voice signal in accordance with the processing values corresponding to the character amounts to generate an output signal having a prosody changed from the prosody of the voice signal, wherein said step of controlling the individual character amounts generates the output signal by changing the individual character amounts of the voice signal by the corresponding processing values.

3. A method for changing a prosody of a voice signal, the method comprising:

a step of extracting character amounts, pertaining to a prosody of voice, from a voice signal sequentially in a time-serial manner;

a step of calculating a difference value between each of the character amounts extracted by the step of extracting sequentially in a time-serial manner and a reference value;

a step of generating processing values, corresponding to individual ones of the character amounts, in accordance with respective ones of the difference values; and a step of controlling the individual character amounts of the voice signal in accordance with the processing values corresponding to the character amounts to generate an output signal having a prosody changed from the prosody of the voice signal, wherein said step of generating processing values calculates, as said processing values, numerical values obtained by subtracting the difference values from a predetermined function value calculated using the difference values as independent variables, said step of controlling the individual character amounts generates the output signal by changing the individual character amounts of the voice signal by the corresponding processing values, when the prosody is to be emphasized, said step of generating processing values calculates the processing values on the basis of the function value set such that an absolute value of the function value exceeds an absolute value of the difference value, and when the prosody is to be depressed, said step of generating processing values calculates the processing value on the basis of the function value set such that the absolute value of the function value falls below the absolute value of the difference value.

4. The method for changing a prosody of a voice signal as claimed in claim 2 wherein said step of generating processing values calculates the processing value such that a rate of change, relative to the difference value, of the processing value increases as an absolute value of the difference value increases.

5. The method for changing a prosody of a voice signal as claimed in claim 2 wherein said step of generating processing values calculates the processing value such that a rate of change, relative to the difference value, of the processing value decreases as an absolute value of the difference value increases.

6. The method for changing a prosody of a voice signal as claimed in claim 2 wherein said step of generating processing values variably controls a relationship between the difference values and the processing values.

7. The method for changing a prosody of a voice signal as claimed in claim 2 which further comprises a step of setting the reference value in accordance with the character amounts extracted by said step of extracting character amounts.

8. The method for changing a prosody of a voice signal as claimed in claim 2 wherein said step of extracting character amounts extracts character amounts of a plurality of types from the voice signal, said step of calculating a difference value calculates, for each of said plurality of types, the difference value between each of the character amounts and the reference value set for the type, said step of generating processing values generates, for each of said plurality of types, the processing values corresponding to the character amounts on the basis of the difference values, and said step of controlling the individual character amounts controls the individual character amounts of the voice signal per each of said plurality of types.

9. The method for changing a prosody of a voice signal as claimed in claim 2 wherein the character amounts are of at least one of two types that are a volume and pitch of the voice.

10. The method for changing a prosody of a voice signal as claimed in claim 2 wherein said step of generating processing values calculates a processing value corresponding to the difference value in accordance with a predetermined function.

11. The method for changing a prosody of a voice signal as claimed in claim 10 wherein said step of generating processing values changes a characteristic of the predetermined function in accordance with a parameter for controlling emphasis or depression of the prosody.

12. The method for changing a prosody of a voice signal as claimed in claim 2 which further comprises a step of generating a control parameter for controlling emphasis or depression of the prosody, and wherein, when the prosody is to be emphasized in accordance with the parameter generated by said step of generating a control parameter, said step of generating processing values generates the processing value such that an absolute value of the processing value increases as the difference value increases, and said step of controlling the individual character amounts processes the voice signal in such a manner as to emphasize the prosody of the voice signal as the absolute value of the processing value increases, and wherein, when the prosody is to be depressed in accordance with the parameter generated by said step of generating a control parameter, said step of generating processing values generates the processing value such that the absolute value of the processing value increases as the difference value increases, and said step of controlling the individual character amounts processes the voice signal in such a manner as to depress the prosody of the voice signal as the absolute value of the processing value increases.

13. The method for changing a prosody of a voice signal as claimed in claim 12 wherein, when the prosody is to be emphasized or depressed, the processing value is scaled in accordance with the value of the parameter.

14. The method for changing a prosody of a voice signal as claimed in claim 12 wherein said parameter is automatically generated in response to manual operation by a human operator or in accordance with a predetermined condition.

15. The method for changing a prosody of a voice signal as claimed in claim 2 wherein said step of generating processing values generates the processing value in accordance with the difference value and the parameter for controlling emphasis or depression of the prosody, and wherein, when said parameter is of a neutral value instructing neither emphasis nor depression of the prosody, said step of generating processing values does not generate the processing value irrespective of a value of the difference value, but, when said parameter is of a value instructing either emphasis or depression of the prosody, said step of generating processing values generates the processing value such that an absolute value of the processing value increases as the difference value increases.

16. The method for changing a prosody of a voice signal as claimed in claim 15 wherein, when the prosody is to be emphasized or depressed, the processing value is scaled in accordance with the value of the parameter.

17. The method for changing a prosody of a voice signal as claimed in claim 15 wherein said parameter is automatically generated in response to manual operation by a human operator or in accordance with a predetermined condition.

18. The method for changing a prosody of a voice signal as claimed in claim 2 wherein said step of controlling the individual character amounts controls the individual character amounts of the voice signal in accordance with the processing values corresponding to the character amounts to generate the output signal having the prosody of the voice signal changed to be emphasized or depressed.

* * * * *